US006199690B1

(12) United States Patent
Shin

(10) Patent No.: US 6,199,690 B1
(45) Date of Patent: Mar. 13, 2001

(54) GOLF BAG WITH HANDLE IN UNIQUE LOCATION AND METHOD

(76) Inventor: Brian B. Shin, 2500 White Rd., Irvine, CA (US) 92714

( * ) Notice: Subject to any disclaimer, the term of this patent is extended or adjusted under 35 U.S.C. 154(b) by 0 days.

(21) Appl. No.: 09/334,751

(22) Filed: Jun. 16, 1999

(51) Int. Cl.[7] ..... A63B 55/00
(52) U.S. Cl. ..... 206/315.3; 383/16
(58) Field of Search ..... 220/767, 772; 383/16; 16/110; 206/315.3, 315.6, 315.4

(56) References Cited

U.S. PATENT DOCUMENTS

| | | | | |
|---|---|---|---|---|
| D. 172,785 | * | 8/1954 | Eging | 206/315.3 |
| D. 320,887 | * | 10/1991 | Jones | 206/315.1 |
| 1,936,021 | * | 11/1933 | Hutchinson | 206/315.3 |
| 2,437,405 | * | 3/1948 | Robinson | 206/315.3 X |
| 2,739,631 | * | 3/1956 | Hamley | 206/315.3 |
| 2,853,111 | * | 9/1958 | Williams | 206/315.3 |
| 3,521,689 | * | 7/1970 | Woods, Jr. | 206/315.4 |
| 4,802,773 | * | 2/1989 | Gross | 383/16 |
| 4,844,253 | * | 7/1989 | Reimers | 206/315.6 |
| 5,860,520 | * | 1/1999 | Tang | 206/315.6 |

FOREIGN PATENT DOCUMENTS

| | | | | |
|---|---|---|---|---|
| 0563215 | * | 9/1958 | (CA) | 206/315.6 |

* cited by examiner

*Primary Examiner*—Allan N. Shoap
*Assistant Examiner*—Tri M. Mai
(74) *Attorney, Agent, or Firm*—John J. Connors; Connors & Associates

(57) ABSTRACT

A golf bag comprises a bag body with a handle located adjacent an open mouth of the bag. The handle is used to facilitate removing the golf bag from a user's shoulder by grasping the handle with one hand while sliding the strap off the shoulder, and lowering the bag to a rest position while maintaining grasping of the handle to support the weight of the golf bag as the bag is lowered.

12 Claims, 3 Drawing Sheets

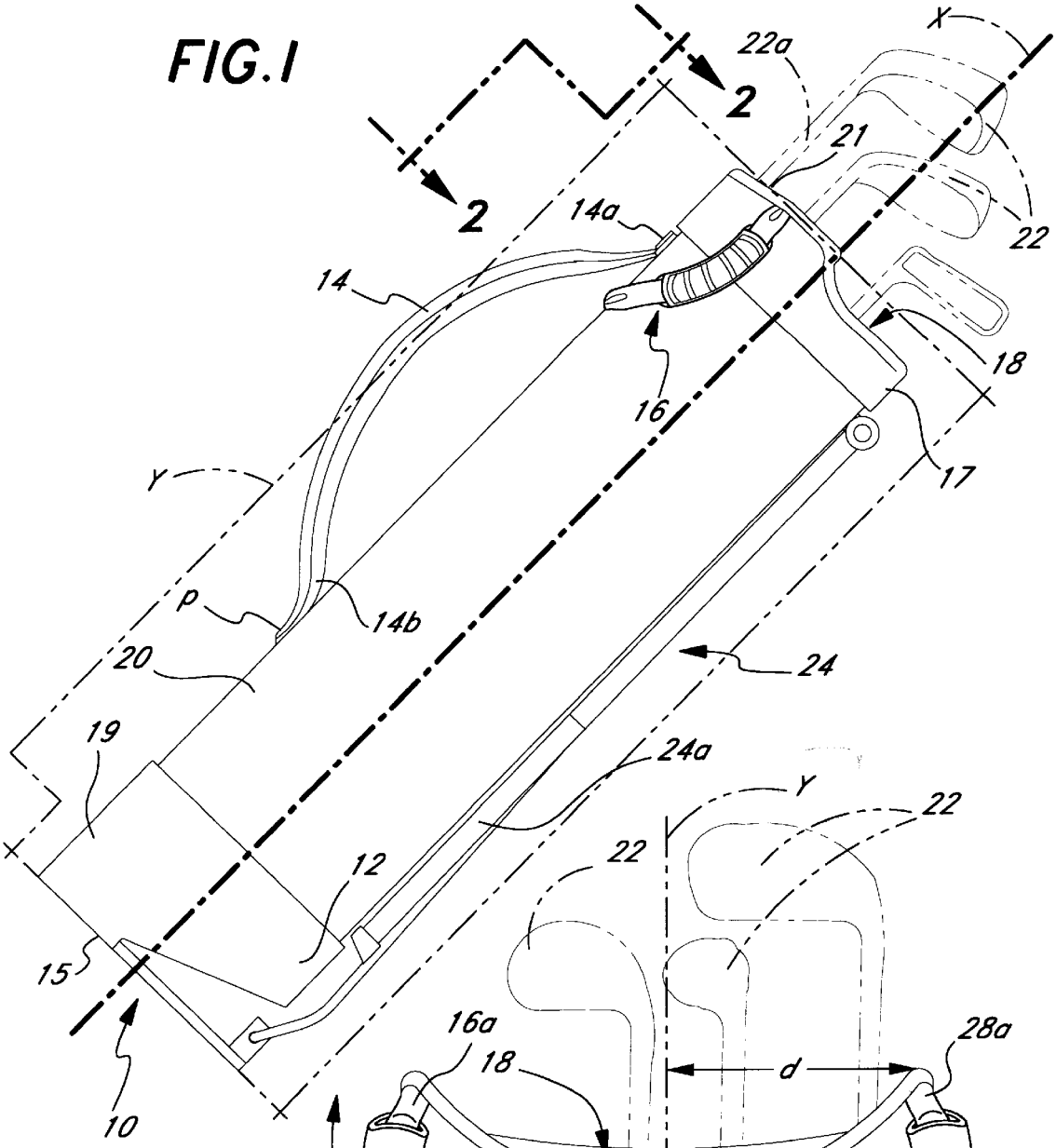
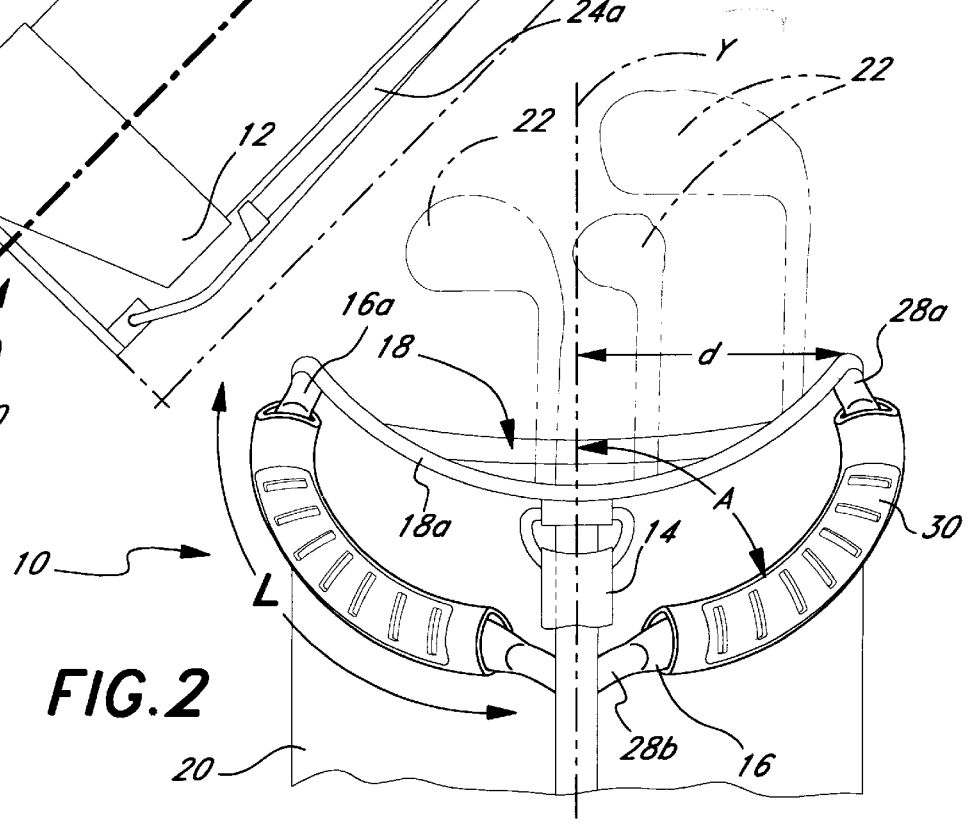
FIG.2

FIG. 4
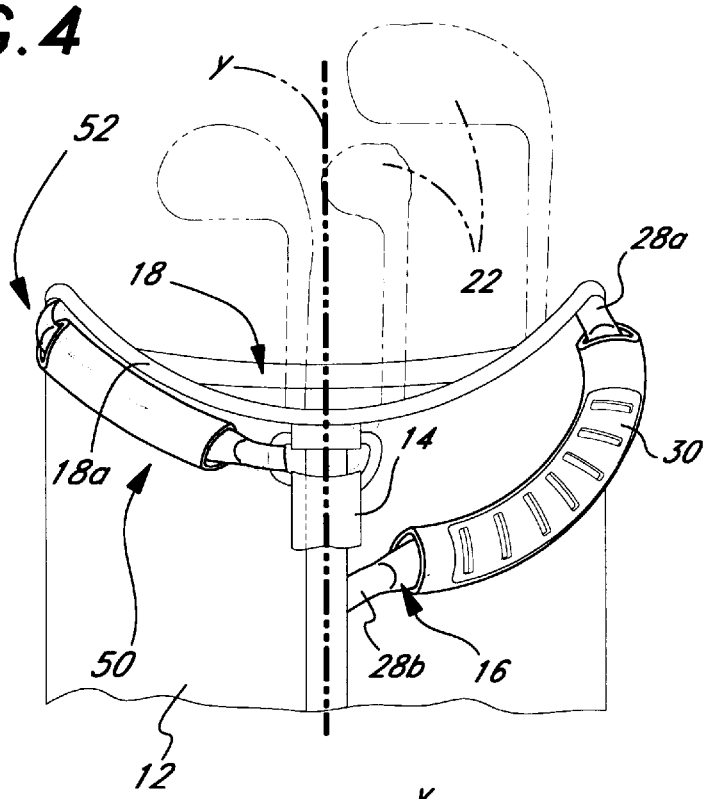
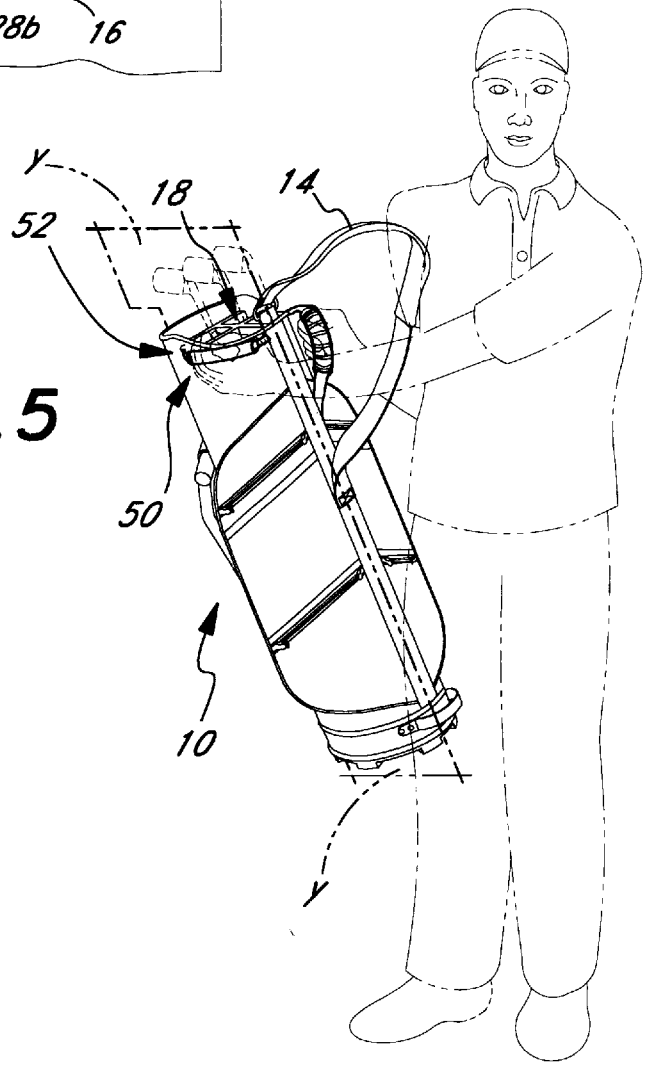
FIG. 5

GOLF BAG WITH HANDLE IN UNIQUE LOCATION AND METHOD

BACKGROUND OF THE INVENTION

Golf Bags typically have a handle located at about midway between the golf bag's open mouth and its closed bottom end along the sidewall of the bag that defines the golf bag body. This handle is usually beneath a strap which has one end attached near the open mouth and another end attached to the sidewall at a point between the handle and the closed bottom. This handle is used to carry the golf bag when the strap is not being employed for this purpose. It has virtually no other utility.

SUMMARY OF THE INVENTION

This invention has several features, no single one of which is solely responsible for its desirable attributes. Without limiting the scope of this invention as expressed by the claims that follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to, ease of use, especially upon removing a golf bag from a user's shoulder and lowering the golf bag to a rest position.

The first feature of the golf bag of this invention is that it includes a bag body having an open mouth at a cavity in the bag body into which golf clubs are placed and a handle located adjacent the open mouth. The handle is positioned at an acute angle with respect to a reference plane that passes through the longitudinal axis of the bag body and is at a right angle to a closed bottom of the bag body. The acute angle is preferably from about 30° to about 60° with respect to the reference plane. Preferably, the length of the handle is from about 4.5 to about 9 inches. The handle has an outward end next to the open mouth that is displaced at least about 2 inches from the reference plane, typically from about 2 to about 5 inches, and an inward end that is at or next to the reference plane.

The second feature is that the bag body near the open mouth has an arcuate surface and the handle includes a flexible gripper member having a shape conforming to the contour arcuate surface. This gripper member extends between first and second connector members attached to the arcuate surface.

The third feature is that there is a pair of handles adjacent the open mouth, one handle being on the left side of the bag body and the other handle being on the right side of the bag body. In one embodiment, these handles are at about equal distances from the reference pane and their angular orientation is such that the relationship between the handles is essentially the same as that of the right hand to the left hand. In another embodiment, a first handle is positioned at an acute angle with respect to, and to one side of, the reference plane and a second handle is on a side of the reference plane opposite the first handle. This second handle is positioned to lie substantially parallel to the rim of the open mouth and adjacent to this rim.

This invention also includes a method of removing a golf bag from a user's shoulder where the bag has a strap that is draped over the user's shoulder and a handle that is located adjacent an open mouth of the golf bag. This method includes the steps of:

grasping the handle with one hand while sliding the strap off the shoulder, and lowering the bag to a rest position while maintaining grasping of the handle to support the weight of the golf bag as the bag is lowered.

The method of this invention also includes using a bag with two handles at the mouth of the bag and grasping both handles while lowering the golf bag from the shoulder.

DESCRIPTION OF THE DRAWING

The preferred embodiments of this invention, illustrating all its features, will now be discussed in detail. These embodiments depict the novel and non-obvious golf bag and method of this invention as shown in the accompanying drawing, which is for illustrative purposes only. This drawing includes the following figures (FIGS.), with like numerals indicating like parts:

FIG. 1 is a side elevational view of the golf bag of this invention showing a handle positioned at the open mouth of the body of the golf bag.

FIG. 2 is a cross-sectional view taken along line 2—2 of FIG. 1.

FIG. 4 is plan view of an alternate embodiment of this invention employing a pair of handles, one along the rim of the golf bag's open mouth and the other at an acute angle to a reference plane.

FIG. 5 is a perspective view illustrating a user removing the golf bag shown in FIG. 4 from his or her shoulder using both the handles at the open mouth of the body of the golf bag.

DETAILED DESCRIPTION OF THE PREFERRED EMBODIMENTS

First Embodiment

Figure 2A:
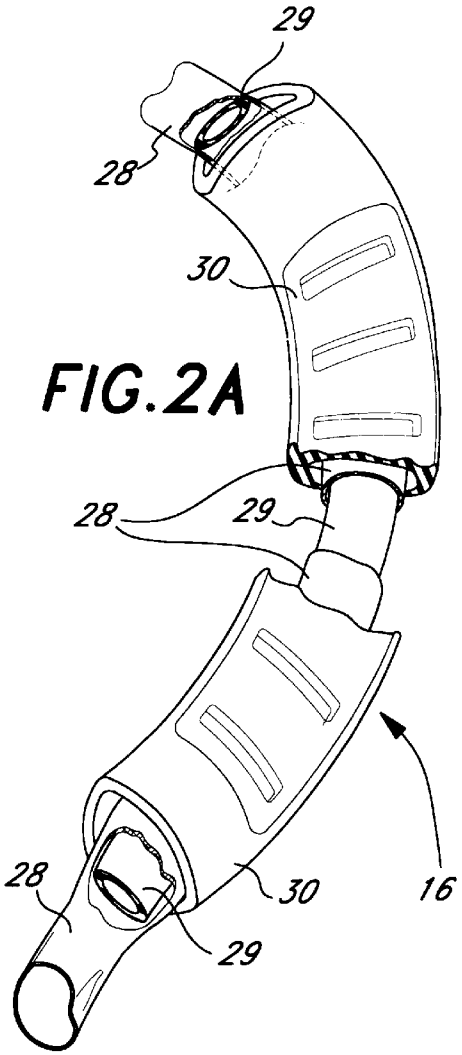
FIG. 2A is an enlarged fragmentary view, with sections broken away, showing the detail construction of the handle.

As shown in FIGS. 1 and 2, the first embodiment of this invention, the golf bag 10, includes a bag body 12, a shoulder strap 14, and a handle 16. The bag body 12 may be any shape, but typically has a cylindrical-like cross-sectional shape. The upper end 17 of the bag body has an open mouth 18 defined by a rim 18*a* (FIG. 2) and the lower end 19 has a closed bottom 15. A sidewall 20 extends between the open mouth 18 and closed bottom 15 to form a cavity 21 within the bag body for holding golf clubs 22. The golf clubs 22 are placed into the open mouth 18 and the shafts 22*a* of golf clubs extend into the cavity 21. The shoulder strap 14 has one end 14*a* attached near the open mouth 18 and another end 14*b* attached to the sidewall 20 at a point P. The strap 14 may have a single loop, through which an arm of the user extends, with the strap loop supported by one shoulder of the user. Alternately, as illustrated in U.S. Pat. No. 5,558,259, the strap 14 may have a pair of loops through which, respectively, each arm of the user extends, with each strap loop supported by one shoulder of the user. Optionally, a support stand 24 with retractable support legs 24*a* such as illustrated in U.S. Pat. No. 5,507,384 may be attached to the sidewall 20.

The handle 16 may be of any conventional configuration. For example, as best shown in FIG. 2A, it may comprise an elongated cloth piece 28 that has its central portion rolled up to enclose a flexible rubber tube 29. The opposed ends 28*a* and 28*b* of the cloth piece are sewn to the sidewall 20. These opposed ends 28*a* and 28*b* respectively form flexible first and second connector members. Surrounding the exterior of the central portion of the cloth piece 28 is a flexible, tubular rubber grip 30 that is concentric with the internal tube 29. The grip 30 is elongated, flexible, and preferably arcuate or curved shape to conform to the curvature of the sidewall 20. Typically, the diameter of the grip 30 is about ¾ inch and it is displaced about 1 inch from the sidewall 20.

In accordance with this invention, when only one handle is used, it is placed on the side of the golf bag corresponding to the user's dominant hand. For example, for a right-handed user, the handle 16 is positioned adjacent the open mouth 18 of the bag body 12 to the right side of the bag body as best shown in FIG. 2. For a left handed user, a handle 16*a* is placed on the left side of the bag such as depicted in FIG. 2. Although only one handle is needed, it is preferred to use two handles on opposite sides of a reference plane y. This reference plane y passes through the longitudinal axis x of the bag body 12 and is at a right angle to the closed bottom 15.

The orientation of the handles 16 and 16*a* is important. These handles are each at an acute angle with respect to the reference plane y. As shown in FIG. 2, the handles 16 and 16*a* are each at an angle A of about 45° with respect to the reference plane y. In this prefer embodiment, the handles 16 and 16*a* each have a length L of about 7 inches. Optionally, the second handle 16*a* is located on the left side of the bag body 12. This second handle 16*a* is identical to the handle 16, expect that its angular orientation is such that the relationship between the handle 16 and 16*a* is essentially the same as that of the right hand to the left hand.

The outward end of the handle 16 is where the end 28*a* of the cloth piece 28 forms the first connector member. This outward end is next to the open mouth 18 near the rim 18*a* and is displaced a distance d of about 4.5 inches to the right from the reference plane y as viewed in FIG. 2. The inward end of the handle 16 is where the end 28*b* of the cloth piece 28 forms the second connector member. This inward end is at (or close to) the reference plane y. The handle 16*a* is similar to handle 16 except that it is to the left side of the reference plane y a s viewed in FIG. 2.

Figure 3:
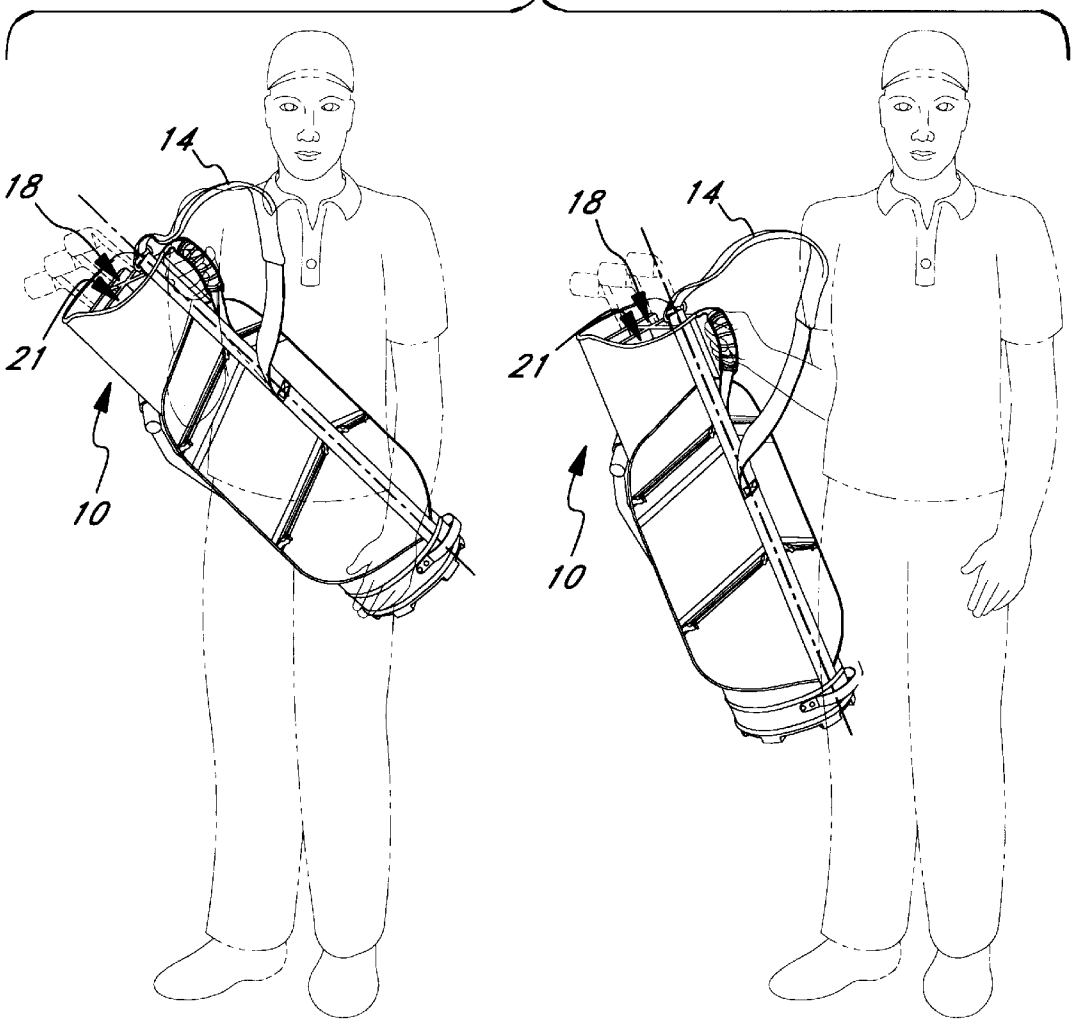
FIG. 3 is a perspective view illustrating a user removing the golf bag shown in FIGS. 1 and 2 from his or her shoulder using the handle at the open mouth of the body of the golf bag.

As shown in FIG. 3, a right-handed user will place the shoulder strap 14 over his or her right shoulder (or in the case of a dual loop strap over both shoulders) and use the right-handed handle 16 to assist in lowering the golf bag 10 to a rest position. A left handed user will place the shoulder strap over his or her left shoulder and use the left handed handle 16*a* to assist in lowering the golf bag to a rest position. As the user begins to slide the shoulder strap 14 off the shoulder he or she simultaneously grasps the handle 16 to support the golf bag 10 as it is lowed. The user maintains his or her grasp of the handle 16 handle to support the weight of the golf bag 10 as the bag is lowered to a rest position. For example, a rest position may be placing the bag on the ground with the legs 24*a* of the 24 extended.

Second Embodiment

As shown in FIGS. 4 and 5, the second embodiment of this invention, the golf bag 50, includes a bag body 12, a shoulder strap 14, and a handle 16 like the first embodiment. In addition to the first handle 16, a second handle 52 substantially identical to handle 16 is employed. This second handle 52 is on the left side of the reference plane y opposite the handle 16 and it is positioned so that it lies along the rim 18*a* of the open mouth 18. This second embodiment as shown in FIG. 4 is designed for a right-handed user. An embodiment for a left-handed user would have the orientation of the handles 16 and 52 changed to accommodate such a left-handed user. In such a case, the handle 50 would be oriented the same as depicted by the handle 16*a* shown in FIG. 2 and the handle 16 would be positioned to lie along, and adjacent to, the rim 18*a*.

As shown in FIG. 5, when a right-handed user lowers the golf bag 50, he or she grasp the handle 16 with his or her right hand and the handle 52 with his or her left hand and lowers the bag 50 with the strap 14 sliding off the right shoulder of the user. The reverse would be the case if the user were left-handed and a left handed handle configuration as discussed above is used.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A golf bag comprising a bag body having a longitudinal axis, a cavity in which golf clubs are placed, an open mouth, a closed bottom end, and a sidewall, and a pair of handles adjacent the open mouth, each said handle having a first connector member attached to the sidewall of the bag body at the open mouth and offset from a reference plane that passes through the longitudinal axis of the bag body and is at a right angle to the closed bottom, a second connector member attached to the sidewall of the bag body inward from the open mouth and at or near the reference plane, and a gripper member extending between the first and second connector members and having opposed ends, one end attached to the first connector member and another end attached to the second connector members, one handle being to one side of the reference plane and the other handle being to the other side of the reference plane, said handles being equal distances from the reference pane and their angular orientation being such that the relationship between the handles is essentially the same as that of the right hand to the left hand, the bag body near the open mouth having an arcuate surface and each handle including a flexible gripper member having a shape conforming to the contour of the arcuate surface.

2. The golf bag of claim 1, where the first connector member is offset at least 2 inches from the reference plane.

3. The golf bag of claim 2 where the handle is at an acute angle from 30° to 60° with respect to the reference plane.

4. The golf bag of claim 3, where the length of the handle is from 4.5 to 9 inches.

5. A golf bag comprising a bag body having a sidewall, a cavity in which golf clubs are placed, a longitudinal axis, an open mouth with a rim thereat, and a closed bottom, and first and second handles located adjacent the open mouth, the first handle being adjacent the open mouth and having a length of from 4.5 to 9 inches, said first handle having a first connector member attached to the sidewall of the bag body at the open mouth and offset from a reference plane that passes through the longitudinal axis of the bag body and is at a right angle to the closed bottom, said first connector member being offset at least 2 inches from the reference plane, a second connector member attached to the sidewall of the bag body inward from the open mouth and at or near the reference plane, and a gripper member extending between the first and second connector members and having opposed ends, one end attached to the first connector member and another end attached to the second connector member, said first handle being at an acute angle from 30° to 60° with respect to the reference plane, and the second handle being on a side of the reference plane opposite the first handle and positioned to lie substantially parallel to the rim of the open mouth and adjacent thereto.

6. A method of removing a golf bag from a user's shoulder where the bag has a strap that is draped over the user's shoulder, comprising the steps of providing a handle adjacent the open mouth and having a length of from 4.5 to 9 inches, said handle having a first connector member attached to the sidewall of the bag body at the open mouth and offset from a reference plane that passes through the longitudinal axis of the bag body and is at a right angle to the closed bottom, said first connector member being offset at least 2 inches from the reference plane, a second connector member attached to the sidewall of the bag body inward from the open mouth and at or near the reference plane, and a gripper member extending between the first and second connector members and having opposed ends, one end attached to the first connector member and another end attached to the second connector member, said handle being at an acute angle from 30° to 60° with respect to the reference plane, grasping the handle with one hand while sliding the strap off the shoulder, and lowering the bag to a rest position while maintaining grasping of the handle to support the weight of the golf bag as the bag is lowered.

7. The method of claim 6, where the handle is on the right side of the golf bag and the right hand of the user is used to grasp the handle and lower the golf bag to the rest position.

8. The method of claim 6, where the handle is on the left side of the golf bag and the left hand of the user is used to grasp the handle and lower the golf bag to the rest position.

9. A method of removing a golf bag from a user's shoulder where the bag has a strap that is draped over the user's shoulder and an open mouth with a rim, comprising the steps of providing a pair of handles adjacent the open mouth, one of said handles having a length of from 4.5 to 9 inches and a first connector member attached to the sidewall of the bag body at the open mouth and offset from a reference plane that passes through the longitudinal axis of the bag body and is at a right angle to the closed bottom, said first connector member being offset at least 2 inches from the reference plane, a second connector member attached to the sidewall of the bag body inward from the open mouth and at or near the reference plane, and a gripper member extending between the first and second connector members and having opposed ends, one end attached to the first connector member and another end attached to the second connector member, said one handle being at an acute angle from 30° to 60° with respect to the reference plane, grasping each handle with one hand while sliding the strap off the shoulder, and lowering the bag to a rest position while maintaining grasping of the handles to support the weight of the golf bag as the bag is lowered.

10. The method of claim 9, where the second handle is on a side of the reference plane opposite the first handle and positioned to lie substantially parallel to the rim of the open mouth and adjacent thereto.

11. A golf bag comprising a bag body having a longitudinal axis, a cavity in which golf clubs are placed, an open mouth, a closed bottom end, and a sidewall, and a handle adjacent the open mouth and having a length of is from 4.5 to 9 inches, said handle having a first connector member attached to the sidewall of the bag body at the open mouth and offset from a reference plane that passes through the longitudinal axis of the bag body and is at a right angle to the closed bottom, said first connector member being offset at least 2 inches from the reference plane, a second connector member attached to the sidewall of the bag body inward from the open mouth and at or near the reference plane, and a gripper member extending between the first and second connector members and having opposed ends, one end attached to the first connector member and another end attached to the second connector member, said handle being at an acute angle from 30° to 60° with respect to the reference plane.

12. The golf bag of claim 11 where the bag body near the open mouth has an arcuate surface and the gripper member is flexible and has a shape conforming to the contour of the arcuate surface.

* * * * *